United States Patent [19]

Sathe

[11] 4,450,284

[45] May 22, 1984

[54] METHOD FOR PURIFYING N-BENZYLOXYCARBONYL ASPARTIC ACID

[75] Inventor: Avinash T. Sathe, Mundelein, Ill.

[73] Assignee: PPG Industries, Inc., Pittsburgh, Pa.

[21] Appl. No.: 483,057

[22] Filed: Apr. 7, 1983

Related U.S. Application Data

[63] Continuation-in-part of Ser. No. 291,584, Aug. 10, 1981, abandoned.

[51] Int. Cl.[3] ..... C07C 125/06

[52] U.S. Cl. ..... 560/163

[58] Field of Search ..... 560/163

[56] References Cited

U.S. PATENT DOCUMENTS

| | | | |
|---|---|---|---|
| 3,492,131 | 1/1970 | Schlatter | 99/141 |
| 3,808,190 | 4/1974 | Dahlmans et al. | 260/112.5 |
| 4,293,706 | 10/1981 | Gorman et al. | 560/163 |
| 4,345,091 | 8/1982 | Sugiyama et al. | 560/163 |

OTHER PUBLICATIONS

Berichte d.D. Chem. Gesellschaft, vol. 65, pp. 1192–1201, 1197 (1932), "Concerning a Universal Process for the Synthesis of Peptides", by Max Bergmann et al.

Houben-Weyl, vol. XV/1, p. 321 (1974).

*Primary Examiner*—Michael L. Shippen

*Attorney, Agent, or Firm*—Irwin M. Stein

[57] ABSTRACT

N-benzyloxycarbonyl aspartic acid containing minor contaminating amounts of N-benzyloxycarbonyl aspartyl aspartic acid is purified by subjecting the impure material to alkaline hydrolysis at a pH of from 10 to 12 and at temperatures of from 30° C. to 100° C., preferably 65° C. to 90° C., for a time sufficient to hydrolyze substantially all of the N-benzyloxycarbonyl aspartyl aspartic acid impurity therein. N-benzyloxycarbonyl aspartic acid containing less than 0.2 weight percent of the impurity can be obtained by such treatment.

19 Claims, No Drawings

METHOD FOR PURIFYING N-BENZYLOXYCARBONYL ASPARTIC ACID

CROSS REFERENCE TO RELATED APPLICATIONS

This application is a continuation-in-part application of my application Ser. No. 291,548, filed Aug. 10, 1981, now abandoned.

DESCRIPTION OF THE INVENTION

The lower alkyl esters of α-L-aspartyl-L-phenylalanine that have 1 to 4 carbon atoms in the alkyl group have a taste closely resembling that of sugar and are, therefore, valuable sugar substitutes. See, for example, U.S. Pat. No. 3,492,131. One such dipeptide, i.e., L-aspartyl-L-phenylalanine methyl ester (aspartame), is described as 100 to 200 times as sweet as sucrose. The aforementioned dipeptide esters are conveniently manufactured from the aspartic acid derivative wherein the amino function is protected by a benzyloxycarbonyl group, the β-carboxy function is protected by a benzyl ester group, and the α-carboxy group is protected by a p-nitrophenyl ester group. The preparation of that aspartic acid derivative is described by S-Guttmann in Helv. Chim. Acta, 44, 721 (1961). Further reaction of that derivative with a phenylalanine ester, e.g., L-phenylalanine methyl ester, produces a protected dipeptide which, when subjected to hydrogenation, produces the lower alkyl ester, e.g., the methyl ester of L-aspartyl-L-phenylalanine. The aforesaid aspartic acid derivative can be prepared from N-benzyloxycarbonyl-L-aspartic acid.

The use of the aforementioned dipeptide sweetening agents in edible materials requires that aspartic acid derivatives utilized as precursers in the synthesis of the dipeptide sweetening agent be as pure as possible. Thus, it is most desirable that such precursers be substantially free of by-products formed during their chemical synthesis.

N-benzyloxycarbonyl aspartic acid, a precursor, of the aforesaid aspartic acid derivative, is commonly prepared by reacting a water soluble alkali metal salt of L-aspartic acid with benzyl chloroformate. In the course of that reaction, a small quantity of the alkali metal salt of N-benzyloxycarbonyl aspartic acid reacts with the L-aspartic acid salt reactant to form a minor contaminating amount of the by-product adduct, N-benzyloxycarbonyl aspartyl aspartic acid.

It has now been discovered that this by-product impurity, i.e., N-benzyloxycarbonyl aspartyl aspartic acid, can be removed from the N-benzyloxycarbonyl aspartic acid product by alkaline hydrolysis. In particular, it has been discovered that N-benzyloxycarbonyl aspartic acid containing less than 0.2, more usually less than 0.1, weight percent of the N-benzyloxycarbonyl aspartyl aspartic acid by-product can be prepared by digesting the said by-product—containing aspartic acid product at a pH of from at least about 10 to 12 at temperatures of from about 30° C.–100° C. In a preferred embodiment, the by-product—containing aspartic acid product is digested at a pH of from about 11 to 12, e.g., 11–11.5, at temperatures of from 30° C. to 100° C., e.g., 65° C.–90° C., for from 0.5 to 12, e.g., 1 to 4, hours.

DETAILED DESCRIPTION

The reaction of aspartic acid with benzyl chloroformate has been described in the literature. See, for example, the article, "Concerning a Universal Process for the Synthesis of Peptides" by Max Bergmann et al, Berichte d.D. Chem. Gesellschaft, Volume 65, pages 1192–1201, 1197 (1932) and Houben-Weyl, Volumn XV/1, page 321 (1974). The reaction is also described in Example 1 of U.S. Pat. No. 3,808,190.

In a typical process for the preparation of N-benzyloxycarbonyl aspartic acid (hereinafter Z-Asp), benzyl chloroformate is charged gradually to a reaction vessel containing an aqueous solution of a dialkali metal salt of L-aspartic acid under controlled conditions of pH and temperature. The pH of the aqueous solution can range between about 7 and 14 during addition of the benzyl chloroformate. Preferably, the pH is maintained at between about 10 and 12, more preferably between 10.75 and 11.75, e.g., between 11.5 and 11.75 in order to reduce the amount of N-benzyloxycarbonyl aspartyl aspartic acid (hereinafter Z-Asp Asp) by-product produced and obtain adequate yields of the desired Z-Asp product. At a pH significantly greater than 11.75, e.g., between 12 and 13.5, significant hydrolysis of the benzyl chloroformate reactant to benzyl alcohol occurs and the Z-Asp product is found to contain more than trace amounts of impurities that are less polar than Z-Asp, as determined by thin layer chromatography (TLC). The yield of Z-Asp is also reduced when the reaction is conducted at a high pH, i.e., a pH of 12 to 13.5. When the pH of the aqueous solution is significantly less than 10.75, e.g., between about 7 and 9, significant quantities, e.g., from about 0.5 to about 16 weight percent (basis Z-Asp) of Z-Asp Asp as well as impurities less polar and more polar than Z-Asp, as determined by TLC, are found in the Z-Asp product.

The Z-Asp product purified in accordance with the present invention contains minor contaminating amounts of Z-Asp Asp. While the herein described process is applicable to Z-Asp containing as much as 16 weight percent Z-Asp Asp, the process will usually be employed with Z-Asp product containing much less Z-Asp Asp since procedures for minimizing the amount of Z-Asp Asp product initially will typically be employed to maximize the yield of Z-Asp. Typically, the Z-Asp will contain less than 5, e.g., from 1 to 3 weight percent, of the Z-Asp Asp, basis the Z-Asp product. Z-Asp containing from 0.2 or 0.3 to 5, e.g., 0.2 or 0.3 to 1 to 3, weight percent Z-Asp Asp will usually be treated in accordance with the herein described method.

As described hereinabove, an aqueous solution of an alkali metal salt of the Z-Asp Asp—containing Z-Asp product is maintained within the pH range of from 10 to 12 for a time sufficient to hydrolyze substantially all of the Z-Asp Asp impurity. Preferably, the pH is maintained at from 11 to 12, more preferably from 11 to 11.5. At a pH greater than 11.5, e.g., greater than 12, it has now been found that Z-Asp tends to hydrolyze. The rate of hydrolysis will depend on the temperature at which alkaline hydrolysis is conducted, i.e., the higher the temperature, the faster the rate of hydrolysis, and the pH valve in excess of 11.5. Thus, it is most preferred that the alkaline hydrolysis described herein be performed at a pH not exceeding 12, e.g., from 10 or 11 to less than 12. The particular pH chosen should be that hydroxyl ion concentration which provides an adequate rate of hydrolysis for commercial applications. It has been observed that the Z-Asp product is substantially unaffected by the herein described treatment, at the preferred described conditions. The pH of the aqueous solution of the Z-Asp Asp—containing Z-Asp product can be monitored during the alkaline hydrolysis step by testing a sample of the solution with a conventional pH meter. Such pH readings should be taken when the solution is at substantially room temperature, e.g., from 20° to 30° C. to insure accurate readings, since at higher temperatures lower than actual pH readings can be obtained, and at temperatures lower than room temperature higher than actual pH readings can be obtained unless the pH meter is calibrated properly.

The aforesaid pH of the Z-Asp aqueous solution to be treated is obtained by the addition of a water soluble, inorganic alkaline reagent to an aqueous slurry of the contaminated Z-Asp product or to an aqueous solution of an alkali metal salt of such Z-Asp product having a pH less than 10. Preferably, the alkaline reagent used is an alkali metal hydroxides, e.g., sodium hydroxide or potassium hydroxide. Addition of the alkali metal hydroxide to an aqueous slurry of Z-Asp produces an aqueous solution of the alkali metal salt of N-benzyloxycarbonyl aspartic acid.

The amount of alkaline reagent added to the Z-Asp slurry or aqueous solution is that amount required to bring to and maintain a solution of the material to be treated at the desired pH for the period of treatment. The concentration of the alkaline reagent used is not critical. In the case of sodium or potassium hydroxide, it is common to utilize between a 20 and 50 weight percent solution thereof.

The above-described hydrolysis reaction can be conducted at temperatures between about 30° C. and about 100° C. Preferably, the temperature of the reaction is between 50° C. and 100° C., more preferably, between 65° C. and 90° C., e.g., 80° C. to 85° C. The rate at which the hydrolysis reaction proceeds is a direct function of the temperature used. However, as the temperature approaches the upper limit within the aforesaid range, the greater the tendency for decomposition of the Z-Asp product. At temperatures of from 30° C. to 50° C., the rate of hydrolysis is relatively slow. At temperatures of about 20° C. or less (room temperature), the reaction proceeds too slowly for practical commercial applications.

The length of time for which the aqueous solution of the alkali metal salt of Z-Asp is maintained at the desired pH will vary depending on the temperature and pH used. Generally, the higher the temperature used, the shorter the time required for complete alkaline hydrolysis of the Z-Asp Asp by-product. Commonly, time periods of from 0.5 to 12 hours, more usually from 0.5 or 1 to 4 hours are used. Such periods are usually sufficient to hydrolyze substantially all of the Z-Asp Asp by-product, i.e., produce Z-Asp containing less than 0.2 weight percent Z-Asp Asp.

Purification of Z-Asp containing minor amounts of Z-Asp Asp by alkaline hydrolysis can produce a Z-Asp product substantially free of Z-Asp Asp. By substantially free is meant that the Z-Asp recovered contains less than 0.2 weight percent Z-Asp Asp. More preferably, the recovered Z-Asp contains less than 0.1, most preferably less than 0.05, weight percent of Z-Asp Asp, basis the Z-Asp product.

The Z-Asp product produced in accordance with the present process is substantially pure, i.e., it is at least 97 percent (on a weight basis) Z-Asp. Often the product is better than 98 or 99 percent pure. In addition to any remaining unhydrolyzed Z-Asp Asp and other organic impurities, the Z-Asp product can contain small amounts (not more than about one percent) of alkali metal salt, e.g., sodium or potassium chloride, and water. Other organic impurities, i.e., substances that are less polar and more polar than Z-Asp, as determined by thin layer chromatography (TLC), usually represent less than an estimated 0.5, more usually less than 0.2 weight percent of the product. The amount of alkali metal salt remaining in the Z-Asp product is controlled, in part, by the thoroughness with which the product is washed, e.g., with water, following its recovery.

The alkaline hydrolysis treatment described herein can be applied to a Z-Asp product or to a metal e.g., alkali metal, salt thereof, e.g., as an added step to the process for preparing Z-Asp. In the former embodiment, the Z-Asp is slurried in water and alkali, e.g., sodium hydroxide, added to the acid product slowly to form the soluble alkali metal salt of the acid and reach the pH desired for alkaline hydrolysis. Treatment of the resulting aqueous solution then proceeds as described herein. The amount of water used is not critical; but, preferably should be sufficient only to serve as a solvent for the salt and form an easily handled reaction mixture. Since Z-Asp is soluble to a degree in water, the more water used, the more product lost when the Z-Asp product is later separated.

In the latter embodiment, following the reaction sequence which produces the Z-Asp product (usually as a soluble alkali metal salt), the pH of the reaction medium is raised, if necessary, to the desired level for alkaline hydrolysis by the addition of an alkaline reagent, e.g., an alkali metal hydroxide such as sodium hydroxide, and the process of the present invention conducted.

Following alkaline hydrolysis, the Z-Asp product is recovered by preferably first cooling the solution to about room temperature followed by acidification of the reaction mixture with a mineral acid, e.g., hydrochloric or sulfuric acid, to a pH and/or temperature at which the Z-Asp crystallizes from the aqueous solution. The crystalline product is recovered by any conventional solid-liquid separation technique, e.g., filtration, centrifugation, etc. The wet cake recovered can be washed one or more times with an equal weight of water, usually cold water, and the washed product dried, e.g., at 40° C. in a suitable oven, e.g., a circulating air oven.

The aspartic acid used in the preparation of Z-Asp is available commercially as the D(−), L(+) or DL isomers. Any of the aforementioned isomers can be used. For use in preparing sweetening agents, the L(+) stereoisomer is preferred (the DL isomer mixture being less preferred) for the reason that the L-stereoisomer appears to provide the sweetening properties desired.

Benzyl chloroformate is available commercially. It is added slowly and with appropriate agitation in substantially stoichiometric amounts to the reaction mixture in order to avoid the presence of excessive or localized quantities of unreacted benzyl chloroformate within the reaction mixture. Sufficient agitation to promote intimate contact between the reactants should be used. In a preferred embodiment, the rate at which benzyl chloroformate is introduced into the reaction mixture is controlled so that the mole ratio of unreacted benzyl chloroformate to the aspartic acid salt therein in any incremental time frame is not greater than 0.2, preferably not greater than 0.15 and most preferably not greater than 0.1.

The addition of benzyl chloroformate to the reaction mixture at a rate which results in significant quantities of unreacted benzyl chloroformate in the reaction mixture, e.g., by adding the benzyl chloroformate all at once, results in hydrolysis of more than a minor portion of the benzyl chloroformate. The resulting benzyl alcohol forms esters with acidic materials, i.e., carboxylic acid containing materials, that may be present within the reaction mixture. These esters are believed to be the less polar impurities found by TLC in the Z-Asp product. It has been found that the addition gradually and uniformly of benzyl chloroformate to the reactor over a period of at least about 2 hours, e.g., 2 to 3 hours, is sufficient to maintain the mole ratio of unreacted benzyl chloroformate to aspartic acid salt in the reaction mixture at less than the above described level of 0.2 and to control the rate at which heat is generated by the reaction.

The following is an exemplification of the preparation of Z-Asp. Benzyl chloroformate is added to an aqueous solution of an alkali metal salt of aspartic acid. The aforementioned aqueous solution can be prepared by adding alkali metal hydroxide to an aqueous slurry of the acid. As used in the present specification and claims, the term "alkali metal" is intended to mean and include sodium and potassium. In order to obtain an aqueous aspartic acid alkali metal salt solution having the ph desired for the reaction, it is necessary to utilize an alkaline reagent that will provide an aqueous solution at that pH. Sodium hydroxide and potassium hydroxide are examples of such reagents.

In preparing the aspartic acid salt solution, it is convenient to slurry the aspartic acid in water and subsequently add, e.g., by titration, the alkali metal hydroxide to the slurry until the desired pH is reached. However, it is possible to add the aspartic acid to an aqueous solution of alkali metal hydroxide. The aspartic acid is thereby neutralized to form its alkali metal salt, which is water soluble. Slightly more than a stoichiometric amount of alkali metal hydroxide, i.e., sodium or potassium hydroxide (2 moles of hydroxide per mole of aspartic acid) are required to prepare the aforesaid solution.

The amount of water used to prepare the aspartic acid solution is not critical; however, excessive amounts of water are economically disadvantageous. Therefore, only that amount of water which provides a reaction mixture that can be easily handled should be used. For example, a ratio of 0.55 liters of water per mole of aspartic acid has been found to be suitable. The Z-Asp product is soluble to a degree in water, the degree of solubility being a direct function of the temperature of the solution. Thus, the more water used to prepare the aspartic acid solution, the more product lost when the aqueous phase of the reaction mixture is separated from the product.

The overall reaction for the preparation of the disodium salt of Z-Asp (N-benzyloxycarbonyl aspartic acid) can be depicted by the following balance equation:

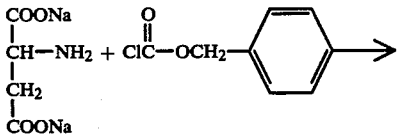

-continued

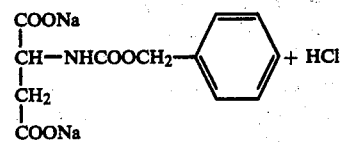

N—Benzyloxylcarbonyl aspartic acid, disodium salt.

Reaction of the sodium salt of N-benzyloxycarbonyl aspartic acid with a further mole of the aspartic acid sodium salt yields (following acidification) the undesired impurity, N-benzyloxycarbonyl aspartyl aspartic acid (Z-Asp Asp),

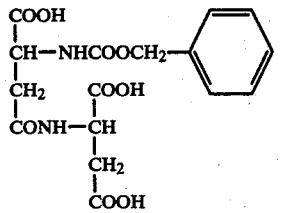

Although the aforesaid formula for Z-Asp Asp has been shown as the $\beta$-amide it is believed that any Z-Asp Asp impurity formed is likely to be present as both the $\alpha$- and $\beta$-amides.

After completing the addition of benzyl chloroformate to the reaction mixture, agitation and addition of alkali metal hydroxide are continued until complete reaction of the benzyl chloroformate occurs. About 0.5 to 1 hour (depending on the rate of benzyl chloroformate addition) is required for the reaction to reach completion, which is indicated by stabilization of the pH of the reaction mixture. Stabilization of the pH is indicated when no additional alkali metal hydroxide is required to be added to the reaction mixture to maintain the pH thereof at the level used to conduct the reaction. Thereafter, the reaction mixture is acidified with cooling to a pH of between about 1.5 and about 2.5 to convert the Z-Asp alkali metal salt product to the free acid. Examples of acids that can be used include hydrochloric acid and sulfuric acid. Preferably, hydrochloric acid is used as the acid so as not to introduce a further anionic species into the reaction medium. Sufficient cooling is provided to compensate for the heat of neutralization.

The Z-Asp product (free acid) in the acidified reaction mixture crystallizes from the reaction mixture and is separated from its mother liquor by conventional separating means, e.g., by means of a filter or centrifuge. The recovered white granular Z-Asp product is washed with water to remove alkali metal salt and dried at temperatures less than its decomposition temperature.

The present process is more particularly described in the following examples which are intended as illustrative only since numerous modifications and variations therein will be apparent to those skilled in the art.

EXAMPLE I 731 grams of 96.4% N-benzyloxycarbonyl aspartic acid, which was prepared by reaction of the sodium salt of L-aspartic acid with benzylchloroformate at a pH of about 11.3, and which contained about 0.44 weight percent of N-benzyloxycarbonyl aspartyl aspartic acid was added to 2000 grams of tap water at room temperature. To this solution were slowly added 300 milliliters of 50% sodium hydroxide. The temperature and pH of the slurry rose from about 22° C. and 2.19 to 55° C. and 11.3 respectively. The resulting alkaline solution was then heated to 85° C. During the first 20 minutes of heating, the pH of the alkaline solution dropped to about 9.9. The pH was raised by the addition of 20 milliliters of additional 50% sodium hydroxide to the alkaline solution and the solution stirred for 30 minutes until the pH appeared to stabilize at 10.42, measured at 85° C.

The alkaline solution was then held at 85° C. for one hour and then cooled to 8° C. The pH of the cooled solution was 12.17. To this cooled solution were added 450 milliliters of concentrated hydrochloric acid. The acidified solution was stirred for 90 minutes, at which point the solution had a pH of 2.28. The precipitate which formed was filtered and the filter cake washed with 300 milliliters of ice tap water. The washed cake was dried in a 40° C. vacuum oven and 647 grams (88% recovery) of dried product obtained. Analysis of the dried product by liquid chromatography (LC) indicated that it was about 97.2% N-benzyloxycarbonyl aspartic acid which contained less than 0.1 weight % of N-benzyloxycarbonyl aspartyl aspartic acid.

EXAMPLE II

To a one liter round bottom flask containing 400 grams of tap water were added 146.2 grams of a wet cake containing about 80% N-benzyloxycarbonyl aspartic acid (prepared in the manner described in Example I) about 2.78 weight percent of N-benzyloxycarbonyl aspartyl aspartic acid and about 17.9 weight percent water. Analysis for Z-Asp and Z-Asp Asp was by liquid chromatography; analysis for water was by the Karl Fischer method—hence totals of greater than 100% are possible. To this solution, 51.7 milliliters of 50% sodium hydroxide were added slowly. The pH of the aspartic acid slurry rose from an initial value of 2.19 to 11.3 while the temperature increased from 22° C. to about 39° C. during addition of 48.5 milliliters of the sodium hydroxide. At this point, the solution was heated to 85° C. over 40 minutes during which time the pH dropped to 9.72, measured at 85° C. The remaining 3.2 milliliters of sodium hydroxide were added slowly and the solution stirred for about ¾ hour while maintaining the temperature at 85° C. The final pH was 10.42 at 85° C. The solution was then cooled to 8° C. over 70 minutes.

The cooled alkaline solution was acidified to a pH of 1.5 by the addition of 72.4 milliliters of concentrated hydrochloric acid. The acidified solution was stirred overnight at room temperature. No precipitate of Z-Asp was observed. 18.0 milliliters of concentrated hydrochloric acid added to the solution which then reached a pH of 0.95, the solution was cooled to 8° C., and stirred for 4.5 hours. The precipitate which formed was filtered and the filter cake washed with 80 milliliters of ice tap water. The wet cake was vacuum dried for 24 hours at 60° C. to yield 99.3 grams (85% recovery) of dried material. Analysis of the dried product showed it to be 95.5% N-benzyloxycarbonyl aspartic acid which contained 1.04 weight percent N-benzyloxycarbonyl aspartyl aspartic acid.

EXAMPLE III

In a one liter round bottom flask was placed 103 grams of N-benzyloxycarbonyl aspartic acid (Z-Asp) and 201 grams of water. A sample of the Z-Asp charged to the flask was analyzed by liquid chromatography and was found to contain 85.2% Z-Asp, and from 1.05 to 2.84% N-benzyloxycarbonyl aspartyl aspartic acid (Z-Asp Asp). The variation in Z-Asp Asp content was attributed to the non-uniformity of the sample. The sample also was found to contain 6.8% moisture.

The pH of the resulting aqueous slurry was adjusted to 11.5 by the addition thereto of 50% aqueous sodium hydroxide. The temperature of the slurry was permitted to rise during addition of the sodium hydroxide from room temperature to about 50° C. The resulting solution was then warmed with stirring to 85° C. in 35 minutes and maintained at about that temperature for ½ hour. During this period, pH excursions of the solution were observed from a low of 10.86 to a high of 11.7; but, the pH remained at about 11.5 for most of the period. The pH readings were taken by removing a sample of the solution and cooling it to room temperature before taking the reading.

At the end of the ½ hour at 85° C., a sample of the solution was taken and analyzed by liquid chromatography. No Z-Asp Asp or benzyl alcohol was found in the sample. Ten minutes after taking the sample, the solution was cooled to 17° C. and acidified with 43 milliliters of hydrochloric acid. The resulting precipitated product was collected by filtration and washed with 100 milliliters of cold water. The wet cake (94.9 grams) was analyzed by liquid chromatography and no detectable amount of Z-Asp Asp or benzyl alcohol was found.

The data of Examples I–III show that N-benzyloxycarbonyl aspartic acid containing minor amounts of N-benzyloxycarbonyl aspartyl aspartic acid can be treated by alkaline hydrolysis to reduce substantially said impurity. The date of Example II shows that a longer digestion period was required to reduce further the Z-Asp Asp content of the Z-Asp product. As described, digestion for 2½ hours reduced the Z-Asp Asp content by almost 2 percent.

Although the present process has been described with reference to specific details of certain embodiments thereof, it is not intended that such details should be regarded as limitations upon the scope of the invention except as and to the extent that they are included in the accompanying claims.

I claim:

1. A process for purifying N-benzyloxycarbonyl aspartic acid containing minor contaminating amounts of N-benzyloxycarbonyl aspartyl aspartic acid, which comprises (a) admixing alkali metal hydroxide with an aqueous slurry of said contaminated N-benzyloxycarbonyl aspartic acid until the pH of the resulting aqueous solution is within the range of from about 10 to 12, digesting said resulting aqueous solution within said pH range and at temperatures of from 30° C. to 100° C. for a time sufficient to hydrolyze substantially all of the N-benzyloxycarbonyl aspartyl aspartic acid (b) acidifying the digested aqueous solution with mineral acid, thereby to crystallize N-benzyloxycarbonyl aspartic acid substantially free of N-benzyloxycarbonyl aspartyl aspartic acid, and (c) recovering said crystallized N-benzyloxycarbonyl aspartic acid.

2. The process of claim 1 wherein the contaminating amount of N-benzyloxycarbonyl aspartyl aspartic acid is from 0.2 to about 5 weight percent.

3. The process of claim 2 wherein the pH during digestion is between about 11 and 12.

4. The process of claim 2 wherein the time period for digestion is from 0.5 to 12 hours.

5. The process of claim 1 wherein the contaminating amount of N-benzyloxycarbonyl aspartyl aspartic acid is from about 0.3 to about weight percent, the pH during digestion is from about 10 to less than 12, the time period for digestion is from about 0.5 to 4 hours, the temperature during digestion is between 50° C. and 100° C., and the mineral acid is hydrochloric acid.

6. The process of claim 5 wherein the temperature is between 65° C. and 90° C.

7. The process of claim 5 wherein the pH during digestion is from about 11 to less than 12.

8. The process of claim 2 wherein the recovered crystallized N-benzyloxycarbonyl aspartic acid contains less than 0.2 weight percent of N-benzyloxycarbonyl aspartyl aspartic acid.

9. The process of claim 5 wherein the recovered crystallized N-benzyloxycarbonyl aspartic acid contains less than 0.2 weight percent of N-benzyloxycarbonyl aspartyl aspartic acid.

10. A process for purifying N-benzyloxycarbonyl aspartic acid containing minor contaminating amounts of N-benzyloxycarbonyl aspartyl aspartic acid, which comprises digesting an aqueous solution of an alkali metal salt of said N-benzylcarbonyl aspartic acid at a pH of from about 10 to less than 12 and at temperatures of from 50° C. to 100° C. for a time sufficient to hydrolyze substantially all of the N-benzyloxycarbonyl aspartyl aspartic acid.

11. The process of claim 10 wherein the contaminating amount of N-benzyloxycarbonyl aspartyl aspartic acid is from 0.2 to 5 weight percent.

12. The process of claim 11 wherein the aqueous solution of the alkali metal salt of N-benzyloxycarbonyl aspartic acid is digested at a pH of from 11 to less than 12.

13. The process of claim 10 wherein the time of digestion is from 0.5 to 12 hours.

14. The process of claim 10 wherein the contaminating amount of N-benzyloxycarbonyl aspartyl aspartic acid is from about 0.3 to about 3 weight percent, the pH of digestion is from 11 to less than 12, the temperature of the digestion is from 65° C. to 90° C., and the time of digestion is from about 0.5 to 4 hours.

15. The process of claim 10 wherein the alkali metal salt is the sodium or potassium salt.

16. The process of claim 11 wherein the purified N-benzyloxycarbonyl aspartic acid contains less than 0.2 weight percent of N-benzyloxycarbonyl aspartyl aspartic acid.

17. The process of claim 14 wherein the purified N-benzyloxycarbonyl aspartic acid contains less than 0.2 weight percent of N-benzyloxycarbonyl aspartyl aspartic acid.

18. The process of claim 14 wherein the digested solution is acidified with hydrochloric or sulfuric acid and cooled, thereby to produce N-benzyloxycarbonyl aspartic acid substantially free of N-benzyloxycarbonyl aspartyl aspartic acid.

19. In the process for preparing N-benzyloxycarbonyl aspartic acid wherein an aqueous solution of alkali metal salt of aspartic acid is reacted with benzyl chloroformate and the resulting reaction mixture is acidified to crystallize N-benzyloxycarbonyl aspartic acid, the improvement which comprises digesting the solution of alkali metal salt of N-benzyloxycarbonyl aspartic acid prior to acidification at a pH of from about 10 to less than 12 and at temperatures of from 50° C. to 100° C. for from about 0.5 to 4 hours, cooling and acidifying the digested reaction mixture with hydrochloric acid to crystallize N-benzyloxycarbonyl aspartic acid therefrom, thereby to produce N-benzyloxycarbonyl aspartic acid containing less than 0.2 weight percent of N-benzyloxycarbonyl aspartyl aspartic acid.

* * * * *

UNITED STATES PATENT AND TRADEMARK OFFICE

CERTIFICATE OF CORRECTION

PATENT NO. : 4,450,284

DATED : May 22, 1984

INVENTOR(S) : Avinash T. Sathe

It is certified that error appears in the above-identified patent and that said Letters Patent is hereby corrected as shown below:

Claim 5, line 3, "about 0.3 to about weight percent, should be --about 0.3 to about 3 weight percent,--

Claim 19, line 2, "aqueous solution" should be --aqueous alkaline solution--

Signed and Sealed this

*Twenty-fifth* Day of *June 1985*

[SEAL]

*Attest:*

DONALD J. QUIGG

*Attesting Officer* *Acting Commissioner of Patents and Trademarks*